US010065448B2

(12) United States Patent
Stewart

(10) Patent No.: US 10,065,448 B2
(45) Date of Patent: Sep. 4, 2018

(54) CREATION OF A THREE DIMENSIONAL LIQUID ART ON A SURFACE BY UTILIZING A SUPER HYDROPHOBIC COATING

(71) Applicant: Ryan M. Stewart, Phoenix, AZ (US)

(72) Inventor: Ryan M. Stewart, Phoenix, AZ (US)

( * ) Notice: Subject to any disclaimer, the term of this patent is extended or adjusted under 35 U.S.C. 154(b) by 0 days.

(21) Appl. No.: 15/465,807

(22) Filed: Mar. 22, 2017

(65) Prior Publication Data

US 2017/0190209 A1 Jul. 6, 2017

Related U.S. Application Data

(63) Continuation-in-part of application No. 14/724,712, filed on May 28, 2015, now abandoned.

(60) Provisional application No. 62/007,784, filed on Jun. 4, 2014.

(51) Int. Cl.

| | |
|---|---|
| ***B44C 3/02*** | (2006.01) |
| ***B44F 7/00*** | (2006.01) |
| ***B44F 11/00*** | (2006.01) |
| ***B44D 2/00*** | (2006.01) |
| ***B44D 3/18*** | (2006.01) |
| ***B44D 5/00*** | (2006.01) |

(52) U.S. Cl.

CPC ..... *B44C 3/025* (2013.01); *B44D 2/00* (2013.01); *B44D 2/005* (2013.01); *B44D 3/18* (2013.01); *B44D 5/00* (2013.01); *B44F 7/00* (2013.01); *B44F 11/00* (2013.01); *Y10T 428/24802* (2015.01); *Y10T 428/24826* (2015.01)

(58) Field of Classification Search

CPC . B44D 5/00; B44D 2/00; B44D 2/005; B44D 3/18; Y10T 428/24802; Y10T 428/24826

See application file for complete search history.

(56) References Cited

U.S. PATENT DOCUMENTS

| | | | |
|---|---|---|---|
| 3,841,903 | A | 10/1974 | Huang |
| 4,702,942 | A | 10/1987 | Wood |
| 5,773,091 | A | 6/1998 | Perlman |

(Continued)

FOREIGN PATENT DOCUMENTS

WO WO 2009/144495 A1 * 12/2009 ..... C09D 5/16

OTHER PUBLICATIONS

Web Page: article.wn.com, viewed at or around May 12, 2014, see attached non-patent literature, p. 1 http://article.wn.com/view/2013/09/18/Sprayon_NeverWet_street_art_appears_after_it_rains/.

(Continued)

*Primary Examiner* — Betelhem Shewareged

(57) ABSTRACT

The embodied invention is to add coatings to a base board that will create three dimensional liquid art when a suitable liquid (such as water) is added to the board surface. In a preferred embodiment, a super hydrophobic coating is applied to the base board and then a hydrophilic coating in the shape of art is applied. A liquid will naturally collect into the hydrophilic areas of the board to form defined artistic shapes and is repelled by super hydrophobic areas. Alternatively, in other embodiments, the board can be selected with a natural super hydrophobic surface or a natural hydrophilic surface, and then a hydrophilic coating or a super hydrophobic coating, respectively, is applied in an art shape.

2 Claims, 9 Drawing Sheets

(56) References Cited

U.S. PATENT DOCUMENTS

| | | | | |
|---|---|---|---|---|
| 5,788,501 | A | 8/1998 | Hassall | |
| 6,579,353 | B1 | 6/2003 | DeLaMater et al. | |
| 6,805,048 | B2 | 10/2004 | Pearson | |
| 8,011,929 | B2 | 9/2011 | Chen | |
| 2002/0018898 | A1* | 2/2002 | Opolski | A61L 27/34 428/423.1 |
| 2004/0138972 | A1 | 7/2004 | Mendelsohn | |
| 2008/0241478 | A1 | 10/2008 | Costin | |

OTHER PUBLICATIONS

Web Page: boingboing.net, viewed at or around May 12, 2014, see attached non-patent literature, p. 2 http://boingboing.net/2013/09/20/howto-make-hydrophobic-rain-on.html.
Weg Page: www.youtube.com, viewed at or around May 12, 2014, see attached non-patent literature, p. 3 https://www.youtube.com/watch?feature=player_embedded&v=DZrjXSsfxMQ.
Web Page: www.domusweb, viewed at or around May 12, 2014, see attached non-patent literature p. 4 http://www.domusweb.it/en/art/2013/07/31/jogging_soon.html.
Web Page: www.technocrazed.com, view at or around May 12, 2014, see attached non-patent literature p. 5 http://www.technocrazed.com/hydrophobic-liquids-used-to-create-artworks-only-visible-in-rain-video.
Web Page: https://www.youtube.com/watch?v=IPM8OR6W6WE, Published on Nov. 12, 2012 , see attached non-patent literature p. 6.
Web Page: https://www.youtube.com/watch?v=OzN8ul5USXM, Published on Oct. 9, 2014, see non-patent literature p. 6.
Web Page: https://www.youtube.com/watch?v=E94iSzeXw68, Published on May 15, 2014 see non-patent literature p. 7.
Web Page: https://www.youtube.com/watch?v=1O__U_xZNdw, Published on Oct. 4, 2013, see non-patent literature p. 7.

* cited by examiner

CREATION OF A THREE DIMENSIONAL LIQUID ART ON A SURFACE BY UTILIZING A SUPER HYDROPHOBIC COATING

CROSS REFERENCE TO RELATED APPLICATIONS

This application is a continuation in part of U.S. Utility application Ser. No. 14/724,712 filed on May 28, 2015, which claims the benefit of U.S. Provisional Application No. 62/007,784, filed on Jun. 4, 2014. Both prior filed applications are incorporated herein by reference.

STATEMENT REGARDING FEDERALLY SPONSORED RESEARCH OR DEVELOPMENT

Not applicable.

REFERENCE TO SEQUENCE LISTING, A TABLE, OR COMPUTER PROGRAM LISTING

Not applicable.

BACKGROUND OF THE INVENTION (1) Field of the Invention

The embodied invention is directed at art, in particular temporary art that is created for decorative and festive events, or more serious artistic expressions. It is three dimensional by the nature of the medium, as it is liquid based such as water, which has a thickness.

(2) Description of Related Art

Others have worked in three dimensional liquids. For example, use of a spray on hydrophobic coating allows for people to stencil off areas, to provide for areas without a hydrophobic coating. After drying, the end result are areas which have a hydrophobic coating will repel water, and the stenciled uncoated areas do not. If water is poured onto the uncoated areas, the result is water wetting the shape of the uncoated area. However, this does not provide the best artistic effect as it is desirable for the surface underneath the water to be a different color or an artistic design.

Others have worked on hydrophobic coatings such as U.S. Pat. No. 6,579,353 and 5,773,091.

BRIEF SUMMARY OF THE INVENTION

The embodied invention is to utilize a precoated board to create three dimensional liquid art when a suitable liquid (such as water) is poured onto the board surface. The liquid naturally pools into the hydrophilic areas of the board to form defined artistic shapes and is repelled by super hydrophobic areas. The pooled water obtains a significant thickness and a rounded edge because the water edges are repelled-contained by the super hydrophobic coating.

In a preferred embodiment, the board surface is covered with both an undercoating of a super hydrophobic coating and top coating of a hydrophilic coating in the shape of art, for the purpose of pooling the fluid onto the hydrophilic coated areas. Paint, particularly an oil based paint with a predetermined surface energy, is useful as a hydrophilic coating.

In another embodiment, a hydrophilic board is chosen and only a super hydrophobic coating is applied and defined artistic areas are left uncoated. The poured liquid is attracted to only the uncoated areas that are naturally hydrophilic. The uncoated area may be created using a stencil to prevent an area from being coated.

BRIEF DESCRIPTION OF THE SEVERAL VIEWS OF THE DRAWING(S)

DETAILED DESCRIPTION OF THE INVENTION

The method of creating a three dimensional art made from liquid and is done by one of two methods following.

A supporting base board is selected for receiving the art. The board could be a thick paper, cardboard, wood, plastic, glass, metal, or a composite. The board has to be strong enough to support the three dimensional art, and also have a suitable surface to receive a super hydrophobic coating. It is preferably clean of dirt, debris, oils, and surface contaminates.

A super hydrophobic coating, such as NeverWet™, is then applied over the entire top surface of the board. It could be painted on, applied with a roller, screen printed, or preferably, applied by a spray system, such as a spray can. Sufficient coating thickness is applied to provide the desired super hydrophobic effect.

After the super hydrophobic coating has dried, a hydrophilic paint is applied to the surface of the super hydrophobic coating so as to create areas that will receive a water and allow it to bead up. It has been found that super hydrophobic coatings will receive paint and allow it to adhere at some level, and the painted areas are very useful to create art. The paint is preferably an oil based paint and is not water soluble.

After the paint has dried, a liquid, such as water, is placed on the top surface of the board. The water is repelled by the super hydrophobic coating and will tend to congregate on the painted areas. The water can be easily manipulated onto the hydrophilic coated areas and pushed off of the super hydrophobic areas. The super hydrophobic coating does not always have a perfect effect of repelling the coating, and a little encouragement to congregate water in the desired areas may be needed. A finger, a tool, a light volume of moving air will be sufficient to clear the super hydrophobic coated areas.

The artwork can then be admired as a striking art medium. It is useful for party decorations, for art displays, and for creating watermarks on heavy paper and cardboard.

A typical hydrophobic coated surface will generally have a water contact angle of about 90 degrees. However, a super hydrophobic (or ultra hydrophobic) coated surface has a water contact angle of 150 degrees or higher.

When a water drop is applied to a surface covered with a super hydrophobic coating, the high contact angle shapes the water drop with a rounded edge. If the water drop is very small, the weight of the water does not flatten it and it forms into the shape of a sphere. When a larger amount of water is applied to the super hydrophobic surface, the water will spread out over an area and will sustain a high thickness value (between 3 to 6 mm) without any physical edge containment. This has an impressive and atheistically pleasing three dimensional liquid image.

Figure 1:
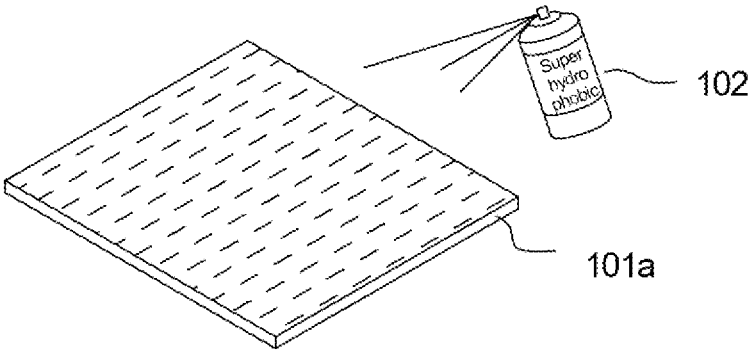
FIGS. 1-4 show a method of coating a board with a super hydrophobic coating and the resulting art.

FIG. 1 shows a method of coating a flat substrate surface 101*a* by spraying on a super hydrophobic coating from a spray can 102. The substrate surface 101*a* must be able to hold a liquid that will be used to create the liquid art work, and also be able to support the weight of the applied water and remain flat and level. The substrate could be any of synthetic paper, fiber, plastic, glass, wood, metal, concrete, or a composite structure. In a preferred embodiment, it is a synthetic paper. The super hydrophobic coating is sprayed on with a sufficient thickness to create a water repellant coating on the surface of the substrate.

Figure 2:
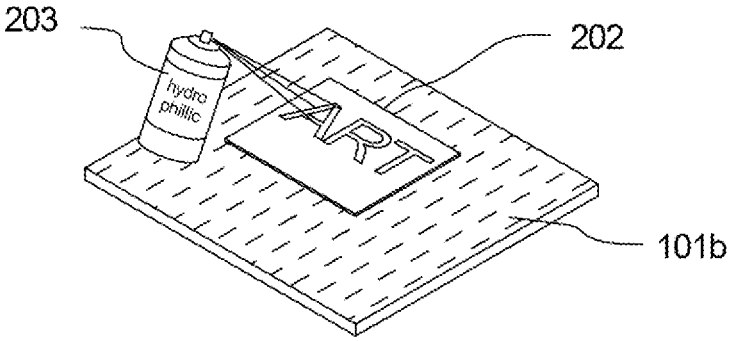

In FIG. 2, the board surface 101*b* is then coated with a dried super hydrophobic coating. A stencil 202 with artwork, such as lettering or pictorial images, is placed on top of the substrate surface 101*b*, and a hydrophilic coating from a spray can 203 is sprayed onto the coated substrate surface 101*b*. The stencil is then lifted up and the hydrophilic coating is allowed to dry. The hydrophilic coating is preferably flat enamel paint, and adheres to the substrate with sufficient adhesive tackiness so that it will be useful to hold a liquid as further explained. In a preferred embodiment, the hydrophilic paint coating has a surface energy of at least 46 dynes/cm after drying.

Figure 3:
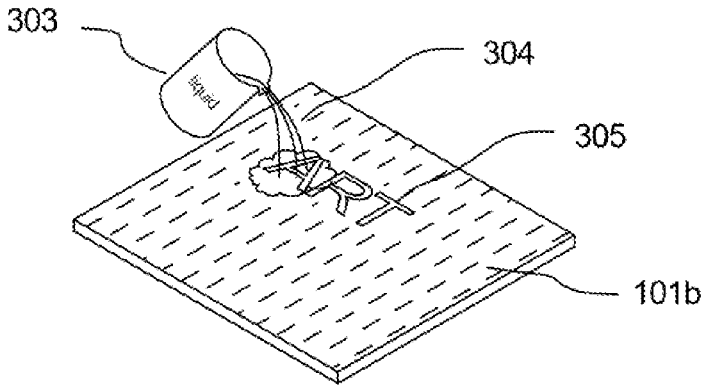

FIG. 3 shows a liquid 304, such as water, being poured out of a container 303 onto the horizontal substrate surface 101*b*. In particular, the liquid is poured onto the hydrophilic letters 305 or hydrophilic art that is bonded to the substrate surface 101*b*. The liquid prefers to remain on the lettering, and not the super hydrophobic coating on the substrate surface. The designer can remove any stray droplets off the super hydrophobic coating by sweeping them off, or by using a light air spray to push the liquid onto the lettering such as compressed air from a can.

Figure 4:
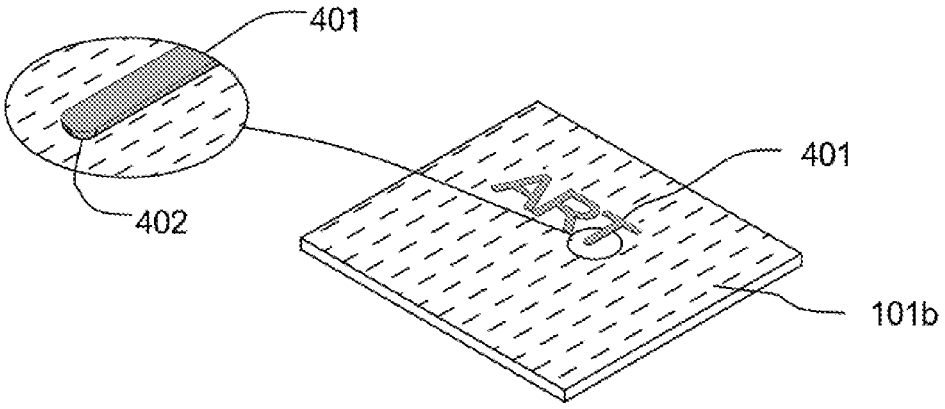

FIG. 4 shows liquid art 401 on the substrate surface 101*b* with the stencil removed. The end result is water that remains on top of the lettering, not the board surface, where the water 'beads up' or collects together on top of the lettering. The water beading tends to curl under the liquid art at the edges 402 due to the high contact angle of the super hydrophobic coating. The water thickness is preferably between 3-6 mm. The thick, raised letters of water create a unique visual art atheistic, and could be called a three dimensional art or a three dimensional liquid art.

The liquid could incorporate various colorants and fillers for a dramatic effect. The enamel paint could also be used to create a visual effect. The painted letters could be a color to contrast with the water or it could also be clear. The substrate could also be clear for a more artistic expression. One important end result of the art is a 'magic' type of effect which will leave observers wondering how it is done. The water strongly tends to create solid lettering (or art) without separating into water beads.

Figure 5:
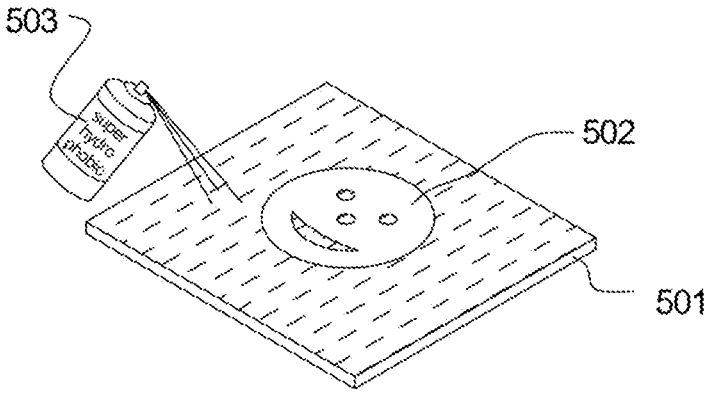
FIGS. 5-8 show s different method of coating a board with a super hydrophobic coating and the resulting art.

FIG. 5 shows an alternate method to create the three dimensional art when the board surface is naturally hydrophilic. Suitable naturally hydrophilic materials include PVC foamboard or synthetic paper. A stencil 502 is placed on a board surface 501 and a super hydrophobic coating 503 is sprayed onto the board surface. The stencil 502 (lettering or artwork) protects a portion of the board from the super hydrophobic coating. Again, the board surface 501 will eventually hold the liquid art work and must be suitably strong enough to remain flat when supporting the weight of the water.

Figure 6:
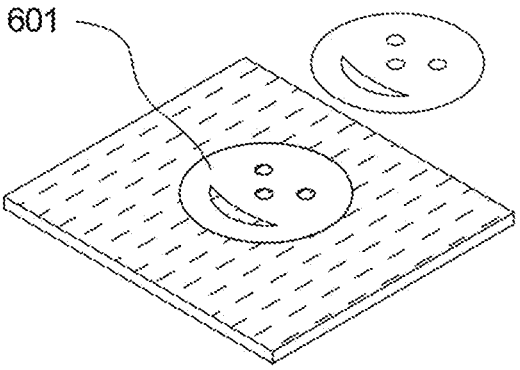

In FIG. 6, the stencil 502 is removed from the substrate surface 501 which is coated with the super hydrophobic coating, which has now dried. An uncoated area 601 remains, and in this case the eyes and mouth of the artwork are coated with the super hydrophobic coating.

Figure 7:
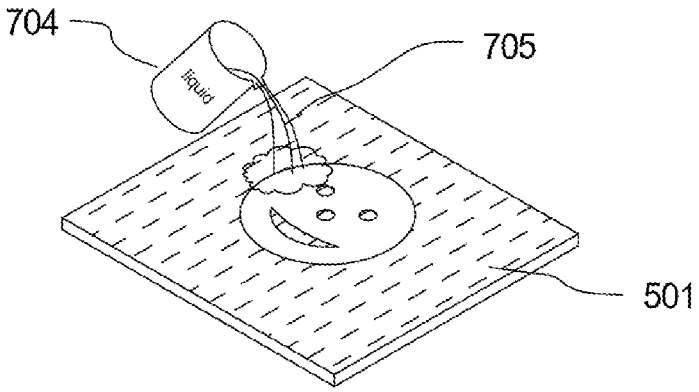

FIG. 7 shows a liquid 705, such as water, being poured out of a container 704 onto the horizontal substrate surface 501. In particular, the liquid is poured onto the uncoated portion of the board. The liquid prefers to remain on the uncoated area, and not congregate on the dried super hydrophobic coating on the substrate surface 501. Preferably, the liquid on the hydrophilic areas is between 3-6 mm thick.

Figure 8:
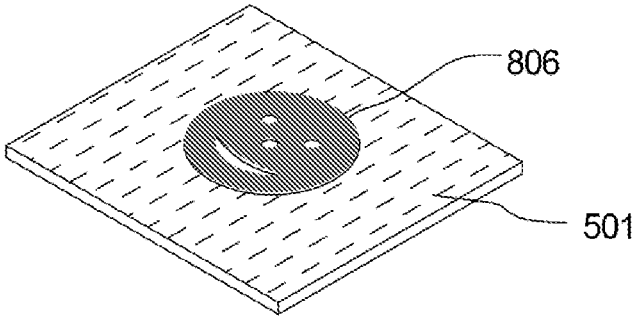

FIG. 8 shows liquid art 806 on the substrate surface 501. As illustrated, the water will collect together and become three dimensional liquid art 806. Again, the liquid could include various colorants (and fillers such as sparkles) for a dramatic effect. The liquid color might be chosen to contrast with the substrate surface 501 or it could be a clear coating.

Figure 9:
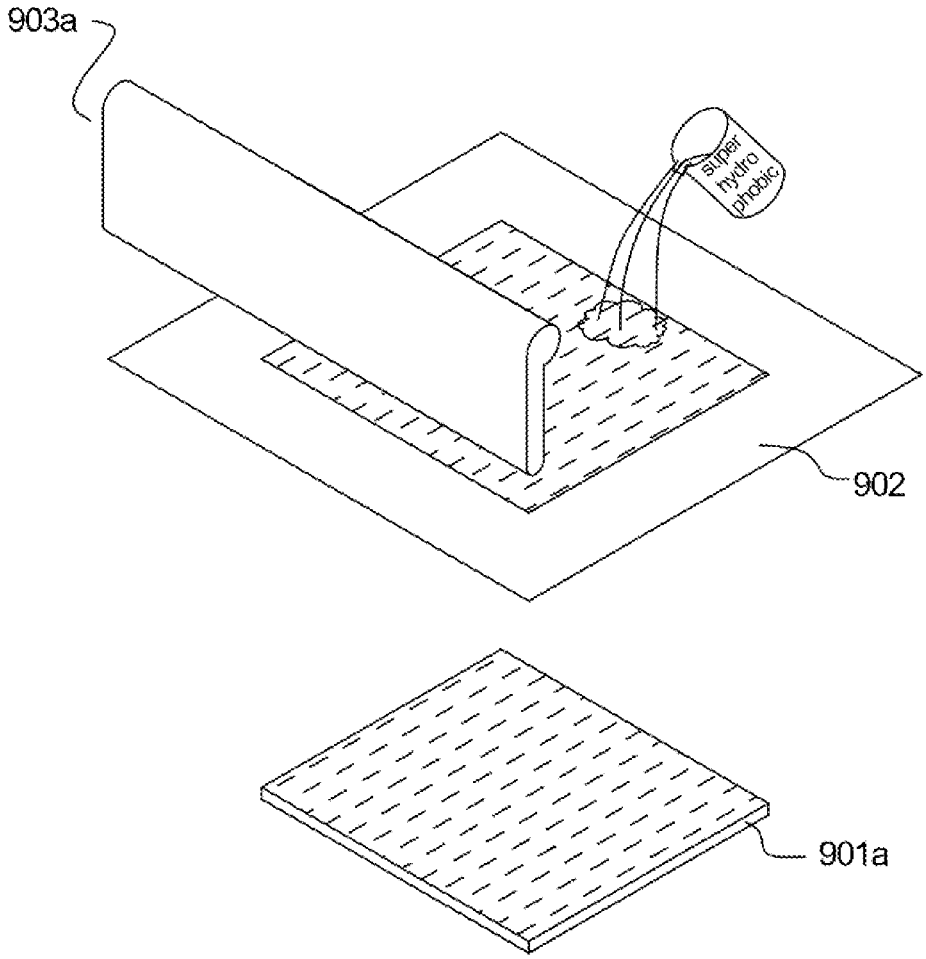
FIGS. 9-12 show a screen printing method to produce liquid art on a surface.
Figure 10:
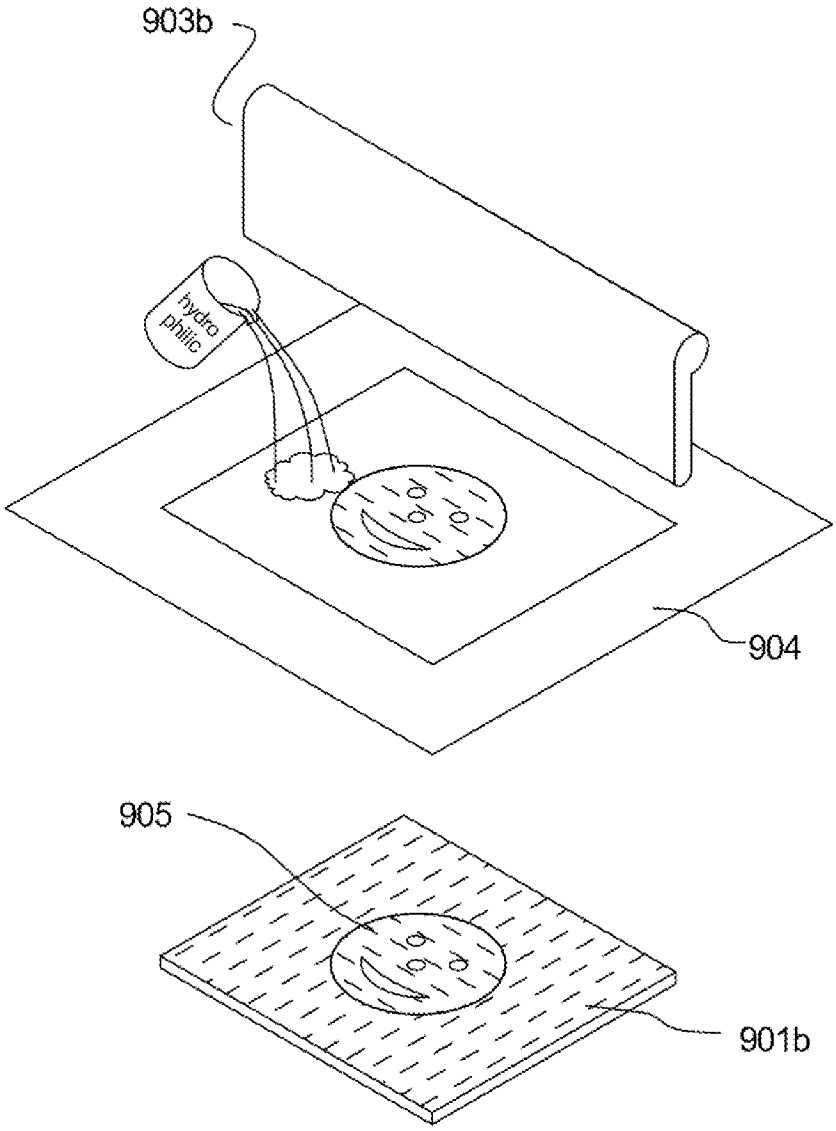

FIG. 9 shows the use of a screen printing method to put on a super hydrophobic coating. A squeegee 903*a* and a mesh screen 902 are used to put a super hydrophobic coating on top of a substrate surface 901*a*. FIG. 10 shows the use of a squeegee 903*b* to coat a screen print with an image 904 onto the coated substrate surface 901*b*. The resulting effect is a hydrophilic coating 905 on top of the super hydrophobic coated substrate surface 901*b* with the desired image.

Figure 11:
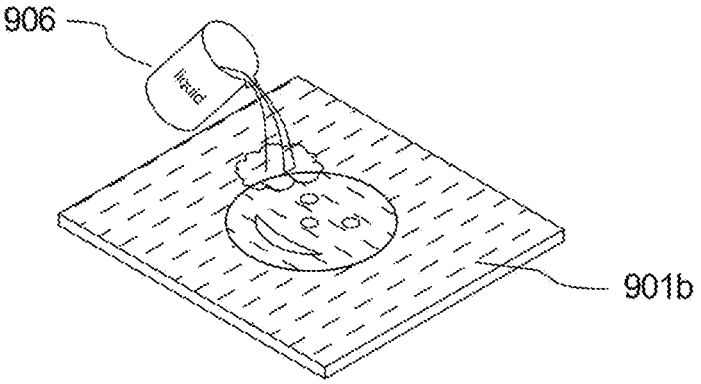
Figure 12:
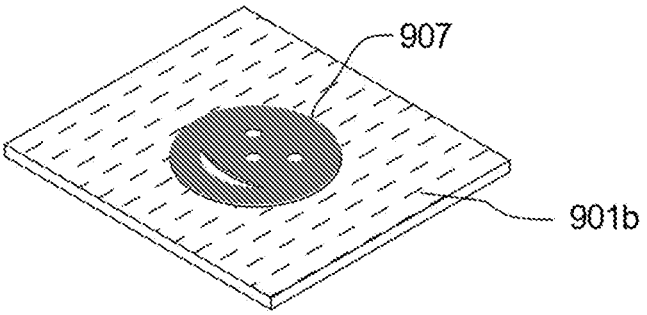

FIG. 11 continues the coating process by showing a liquid container 906 pouring the desired liquid on top of the horizontal coated substrate surface 901*b*. FIG. 12 shows the resulting liquid artwork 907 between 3-6 mm thick.

Figure 13:
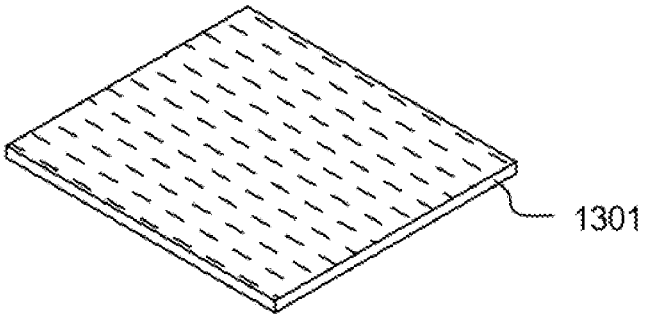
FIGS. 13-16 show an alternate screen printing method to produce liquid art on a surface.
Figure 14:
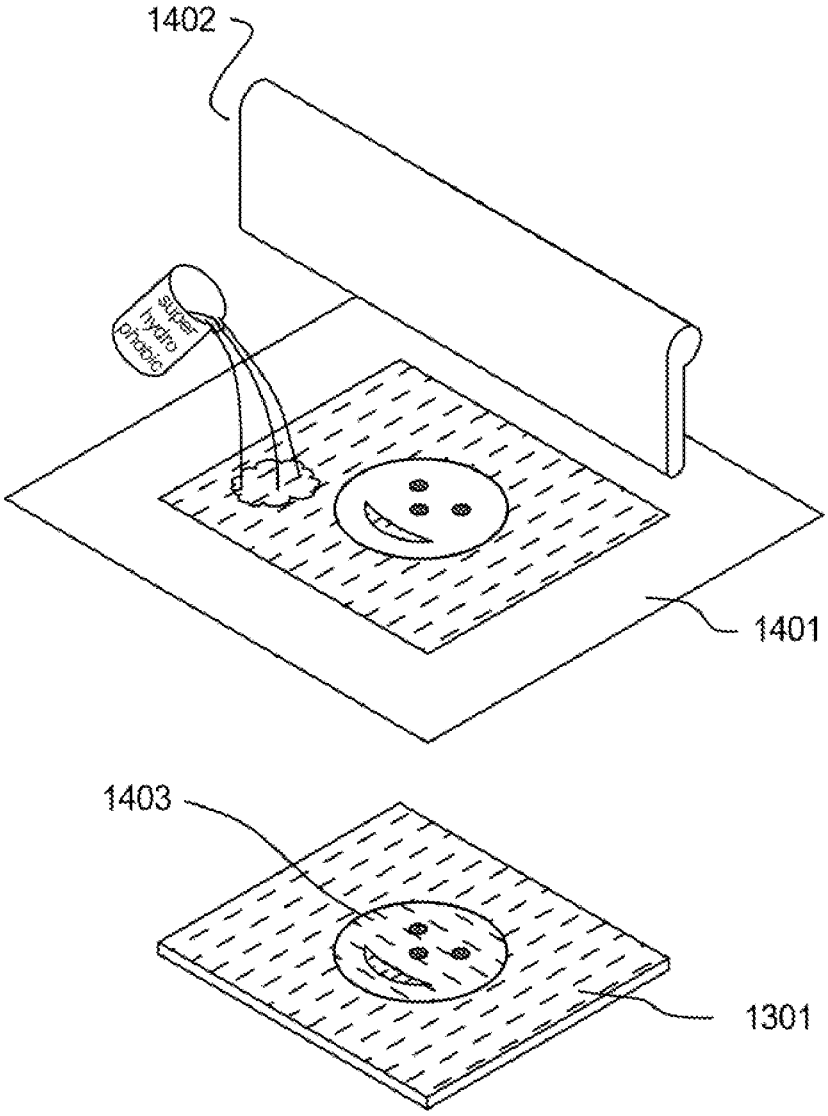

FIG. 13 shows a substrate surface 1301 that is naturally a hydrophilic coating. Suitable naturally hydrophilic materials include PVC foamboard or synthetic paper. In this case, there is no need to use a screen print or spray can to add a hydrophilic coating. In FIG. 14, a squeegee 1402 and a screen print image 1401 are used to put a super hydrophobic coating 1403 on top of the naturally hydrophilic substrate surface 1301 in a manner to allow the area for desired art or letters to be left uncoated.

Figure 15:
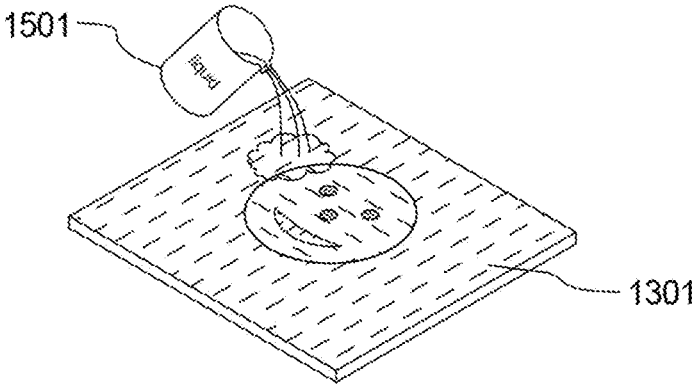
Figure 16:
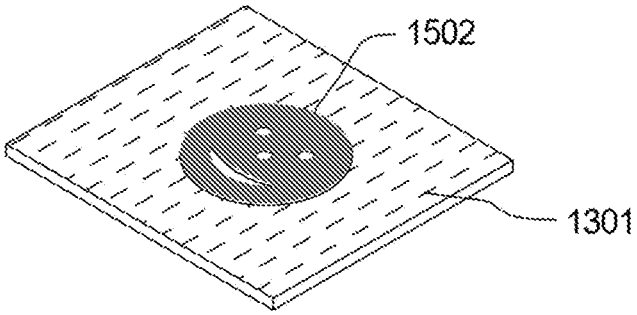

FIG. 15 continues the coating process by showing a liquid container 1501 pouring the desired liquid on top of the naturally hydrophilic substrate surface 1301. FIG. 16 shows the resulting liquid artwork 1502.

All methods of creating the three dimensional liquid artwork allow for the hydrophilic coating or liquid to include a colorant. This allows a more dramatic presentation by using either a clear or colored liquid on top of the hydrophilic coating which may include additional colors or texture. The hydrophilic coating may be applied in multiple layers. This is particularly useful when screen printing is used.

It is also important that the substrate surface is substantially flat and level so that the water will naturally pool on the hydrophilic coated areas.

In addition, whenever a super hydrophobic coating is applied, it optionally includes colors and artwork. It may be applied in multiple layers for a dramatic effect. This is particularly useful when screen printing is used.

In any of the four methods, (i.e. FIGS. 1-4, FIGS. 5-8, FIGS. 9-12, and FIGS. 13-16) the application of the liquid may be performed separately from applying the super hydrophobic and hydrophilic coatings. This is especially useful when the precoated board is sold commercially.

In addition, the art design of the board (i.e. any colors, patterns, etc. in the super hydrophobic or hydrophilic coatings) may be purposefully chosen for commercial sale.

While various embodiments of the present invention have been described, the invention may be modified and adapted to various operational methods to those skilled in the art.

Therefore, this invention is not limited to the description and figure shown herein, and includes all such embodiments, changes, and modifications that are encompassed by the scope of the claims.

I claim:

1. A method of creating a three dimensional water art display by the steps comprising:

A) selecting a flat base board made of material suitable for receiving a super hydrophobic coating on a top surface of said base board, B) positioning said top surface to be level, C) applying said super hydrophobic coating on said top surface thereby creating a coated board, D) wherein said super hydrophobic coating has a contact angle of at least 150 degrees, E) applying a hydrophilic paint on top of said coated board in the shape of artwork, F) wherein said hydrophilic paint is oil based, G) wherein said hydrophilic paint has a surface energy level of at least 46 dynes/cm after drying, H) applying water to substantially cover said hydrophilic paint and substantially avoid areas free of said hydrophilic paint, and I) wherein the thickness of said water on top of said hydrophilic paint is between 3 and 6 mm inclusive, J) wherein at least one item from the group consisting of:

i) said water, ii) said hydrophilic paint, and iii) said super hydrophobic coating, includes a colorant, and K) thereby shaping said water in the shape of said artwork to create said three dimensional water art display.

2. A three dimensional water art display comprising:

A) a flat base board with a top surface that is oriented to be level,

B) a super hydrophobic coating on said top surface,

C) wherein said super hydrophobic coating has a contact angle of at least 150 degrees, D) a hydrophilic paint applied on top of said super hydrophobic coating, E) wherein said hydrophilic paint has a surface energy level of at least 46 dynes/cm after drying, F) wherein said hydrophilic paint is oil based, G) wherein said hydrophilic paint on said super hydrophobic coating is in the form of artwork, H) water on top of said hydrophilic coating, I) wherein said water substantially covers said hydrophilic paint and substantially avoids areas of said base board which are free of said hydrophilic paint, J) wherein said water is 3-6 mm in thickness, K) wherein at least one item from the group consisting of:

i) said water, ii) said hydrophilic paint, and iii) said super hydrophobic coating, includes a colorant.

* * * * *